US009867396B2

(12) United States Patent
Liu

(10) Patent No.: US 9,867,396 B2
(45) Date of Patent: Jan. 16, 2018

(54) ELECTRONIC CIGARETTE CASE

(71) Applicant: HUIZHOU KIMREE TECHNOLOGY CO., LTD. SHENZHEN BRANCH, Shenzhen, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 0 days.

(21) Appl. No.: 14/902,599

(22) PCT Filed: Jul. 3, 2013

(86) PCT No.: PCT/CN2013/078760
§ 371 (c)(1),
(2) Date: Jan. 4, 2016

(87) PCT Pub. No.: WO2015/000151
PCT Pub. Date: Jan. 8, 2015

(65) Prior Publication Data

US 2016/0165952 A1 Jun. 16, 2016

(51) Int. Cl.
*A24F 15/12* (2006.01)
*B65D 43/14* (2006.01)
(Continued)

(52) U.S. Cl.
CPC ..... *A24F 15/12* (2013.01); *A24F 47/002* (2013.01); *B65D 43/14* (2013.01); *B65D 43/165* (2013.01); *B65D 85/70* (2013.01); *A24F 47/008* (2013.01)

(58) Field of Classification Search
CPC ..... A24F 15/12; A24F 47/008; B65D 43/165; B65D 43/167; B65D 43/166; B65D 43/164
(Continued)

(56) References Cited

U.S. PATENT DOCUMENTS 3,001,227 A * 9/1961 Long ..... A47L 15/4261 16/290
3,593,872 A * 7/1971 MacDonald ..... A45C 11/16 220/4.24
(Continued)

FOREIGN PATENT DOCUMENTS

CN 1676435 A 10/2005

OTHER PUBLICATIONS

International Search Report of PCT Patent Application No. PCT/CN2013/078760 dated Apr. 3, 2014.

*Primary Examiner* — Steven A. Reynolds

(57) ABSTRACT

An electronic cigarette case, comprising a case body (2) and a case cover (1) movably connected to the case body (2), also including a flexible structure (3). One end of the flexible structure (3) is connected to the case body (2), while the other end is connected to the case cover (1). When opening the case cover (1), the flexible structure (3) undergoes a first elastic deformation along a moving direction of the case cover (1) relative to the case body (2). When closing the case cover (1), the flexible structure (3) undergoes a second elastic deformation in a direction opposite to the moving direction in which the first elastic deformation occurs. The electronic cigarette case is structurally simple and low-cost.

14 Claims, 6 Drawing Sheets

(51) Int. Cl.
*B65D 85/00* (2006.01)
*B65D 43/16* (2006.01)
*A24F 47/00* (2006.01)

(58) Field of Classification Search
USPC ..... 206/256, 266, 265, 268; 220/254.5, 264
See application file for complete search history.

(56) References Cited

U.S. PATENT DOCUMENTS 5,249,693 A * 10/1993 Gillispie ..... B65F 1/163 220/260
5,501,348 A * 3/1996 Takeuchi ..... B65D 47/0828 215/235
6,364,152 B1 * 4/2002 Poslinski ..... A47J 36/10 215/270
7,004,349 B2 * 2/2006 Heiberg ..... B65D 43/164 220/264
7,614,519 B2 * 11/2009 Krauth ..... B65D 43/169 220/262
8,794,434 B2 * 8/2014 Scatterday ..... A24F 15/12 206/256
8,910,783 B2 * 12/2014 Liu ..... A24F 15/12 206/266
9,302,825 B2 * 4/2016 Liu ..... B65D 43/163
D760,431 S * 6/2016 Liu ..... D27/189
2014/0048992 A1 * 2/2014 Leung ..... B65D 43/166 267/164
2016/0200485 A1 * 7/2016 Quinones ..... B65D 43/24 220/254.5

* cited by examiner

ELECTRONIC CIGARETTE CASE

TECHNICAL FIELD

The present application relates to the technical field of electrical cigarette, and more particularly, relates to an electronic cigarette case.

BACKGROUND

Smoking is harmful to our health. With the improvement of people's health consciousness, more and more people are aware of the dangers of smoking. Smoking does harm to not only the body of a smoker himself, but also the people around. At present, an electronic cigarette is developed, which has a same appearance with a regular cigarette. Smoke may be produced during smoking. However, the electronic cigarette does not contain any hazardous substance such as tar, and thus it is more healthful than the regular cigarette.

An electronic cigarette is equipped with an electronic cigarette case for disposing the electronic cigarette. During smoking, a smoker takes out the electronic cigarette from the electronic cigarette case. However, in general, the open and the close of the electronic cigarette case is achieved by applying a force to an independent cam via a turnover mechanism to make the cam turn over, thereby causing a case cover to turn over. In this case, the independent cam and the fixation thereof need a lot of components, and the manufacturing and processing cost is high.

BRIEF SUMMARY

The objective of the present application is to provide an electronic cigarette case which is structurally simple and low-cost, aiming at the drawbacks in the prior art that the opening and the closing of the case cover of the electronic cigarette case need a lot of components, and the manufacturing and processing cost is high.

In accordance with one aspect of the present application, an electronic cigarette case is provided, which comprises a case body and a case cover rotatably connected to the case body; wherein the electronic cigarette case further comprises a flexible structure; one end of the flexible structure is connected to the case body, and the other end of the flexible structure is connected to the case cover; when opening the case cover, the flexible structure undergoes a first elastic deformation along a moving direction of the case cover relative to the case body; when closing the case cover, the flexible structure undergoes a second elastic deformation in a direction opposite to the moving direction in which the first elastic deformation occurs.

Preferably, during the opening of the case cover, when an angle between the case cover and the case body is larger than 40°, the flexible structure undergoes the first elastic deformation; during the closing of the case cover, when the angle between the case cover and the case body is less than 40°, the flexible structure undergoes the second elastic deformation.

Preferably, the flexible structure includes a deformable portion, and a fixing portion and an abutting portion formed by respectively extending from two ends of the deformable portion; the fixing portion is connected to the case body, and the abutting portion is connected to case cover; the deformable portion undergoes the first elastic deformation or the second elastic deformation during the movement of the case cover, causing the fixing portion and the abutting portion to move in a same direction in such a way that the case cover is closed or opened.

Preferably, cross sections of the fixing portion, the abutting portion and the deformable portion are in shape of curves.

Preferably, the fixing portion and the abutting portion respectively extending from two ends of the deformable portion have the same length; while curvature of the fixing portion is the same as that of the abutting portion.

Preferably, the flexible structure further includes an elastic band; two ends of the elastic band are respectively connected to the two ends of the deformable portion; a deformation space is formed between the deformable portion and the elastic band.

Preferably, a cross-section of the deformation space formed between the deformable portion and the elastic band is in shape of an olive.

Preferably, a strip-shaped hole is defined in the deformable portion; the strip-shaped hole has the same length as the elastic band, and a location of the strip-shaped hole corresponds to that of the elastic band.

Preferably, one end of the flexible structure is fixedly connected to the case body, while the other end of the flexible structure is elastically abutted against the case cover, and is further slidably connected to the case cover.

Preferably, the electronic cigarette case further comprises an accommodating element for disposing electronic cigarettes; the accommodating element is disposed in the case body, and is further detachably connected to the case body; a recess is defined on a side wall of the accommodating element, the side wall is oriented to a movable connection joint between the case body and the case cover; one end of the flexible structure is fixedly mounted in the recess.

Preferably, the case cover includes an upper wall, a side wall, and a limit arm; the side wall downwardly and vertically extends around the upper wall, thereby forming an accommodating cavity; the limit arm is located in the accommodating cavity, and extends perpendicularly from the upper wall towards an opening direction of the case cover; the limit arm has the same extension length as the side wall, and a gap is formed between the limit arm and the side wall.

Preferably, one end of the flexible structure is fixedly mounted in the recess of the accommodating element; the other end of the flexible structure extends into the gap formed between the limit arm and the side wall, and is further elastically abutted against the case cover.

Preferably, the flexible structure further includes a bending portion; the bending portion is arranged on the fixing portion, and is configured to fix the fixing portion into the accommodating element.

Preferably, the bending portion is a buckle, and a buckle hole is defined in a position in the recess of the accommodating element that corresponds to the buckle of the fixing portion; the buckle is buckled into the buckle hole such that the fixing portion is fixed in the accommodating element.

Preferably, the flexible structure is made of metal material.

Preferably, the flexible structure is an integrated type structure.

When implementing the electronic cigarette case of the present application, the following advantageous can be achieved: a flexible structure is mounted in the cigarette case, in such a way that the case cover is opened or closed with an external force being applied to the flexible structure. The mounting of the flexible structure is simple, few assembly components are needed, the flexible structure has a high reliability, and the manufacturing and processing cost is reduced. The opening and the closing of the case cover achieved by the flexible structure feels good.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENT

The electronic cigarette case provided in the present application is suitable for disposing electronic cigarettes. In the present application, a flexible structure is mounted in the cigarette case, in such a way that the case cover is opened or closed with an external force being applied to the flexible structure. The mounting of the flexible structure is simple, few assembly components are needed, the flexible structure has a high reliability, and the manufacturing and processing cost is reduced. The opening and the closing of the case cover achieved by the flexible structure feels good.

Figure 1:
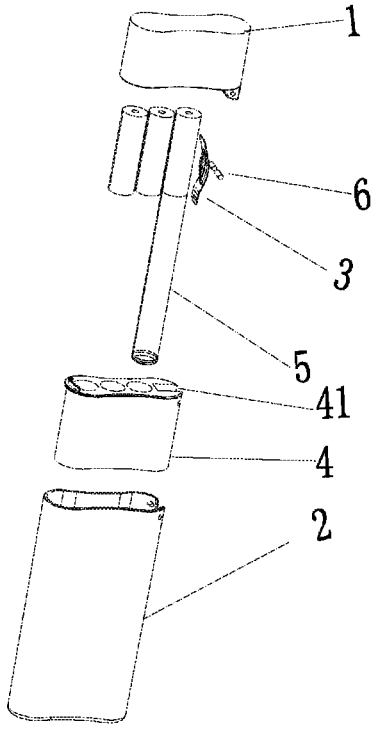
FIG. 1 illustrates an exploded view of an electronic cigarette case according to a preferred embodiment provided in the present application.
Figure 3:
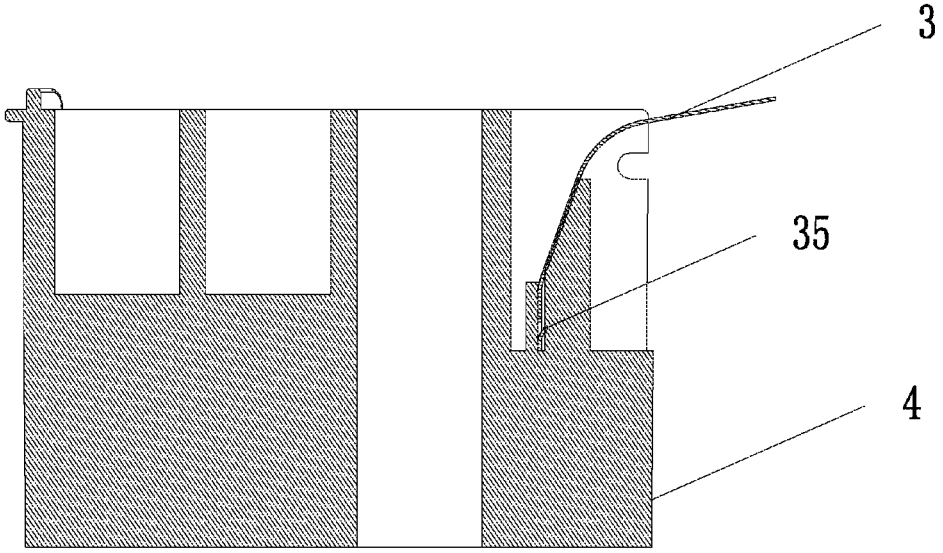
FIG. 3 illustrates an assembly view of the accommodating element and the flexible structure according to the preferred embodiment provided in the present application.

As shown in FIGS. 1 and 3, the electronic cigarette case comprises a case cover 1, a case body 2, a flexible structure 3, and an accommodating element 4 for disposing electronic cigarettes 5. In this case, the case cover 1 is rotatably connected to the case body 2, for example by means of an articulated connection or a pin. In this embodiment, the case cover 1 is connected to the case body 2 by means of a pin 6, in such a way that the case cover 1 is rotatable with respect to the case body 2. The accommodating element 4 is disposed in the case body 2, and is further detachably connected to the case body 2. In this embodiment, a bump is arranged on one side of the accommodating element 4, and a recess is defined in a corresponding position on an inner wall of the case body 2, in such a way that the bump is capable of being snapped into the recess. An accommodating slot allowing the pin 6 to run through is defined on one side wall of the accommodating element 4, and the side wall oriented to a movable connection joint between the case body 2 and the case cover 1. In this way, the case body 2, the case cover 1 and the accommodating element 4 are connected to each other by means of the pin 6.

Certainly, in another embodiment, the accommodating element 4 and the case body 2 are detachably connected to each other by means of embedding or buckling. A recess 41 is defined on a side wall of the accommodating element 4, and the side wall is oriented to a movable connection joint between the case body 2 and the case cover 1. The recess 41 is perpendicular to the accommodating slot allowing the pin 6 to run through. In this embodiment, one end of the flexible structure 3 is fixedly mounted in the recess 41 of the accommodating element 4, and the other end of the flexible structure 3 is elastically abutted against the case cover 1, and is further slidably connected to the case cover 1. In a further embodiment, it is also possible for the flexible structure 3 to be directly and fixedly mounted on the inner wall of the case body 2. In a further embodiment, it is also possible for the flexible structure 3 to be movably connected to the case body 2 by means of engagement, buckling, or the like. In a further embodiment, it is also possible for the flexible structure 3 to be fixedly connected to the case cover 1 by means of thread connection, soldering, or the like.

Figure 4:
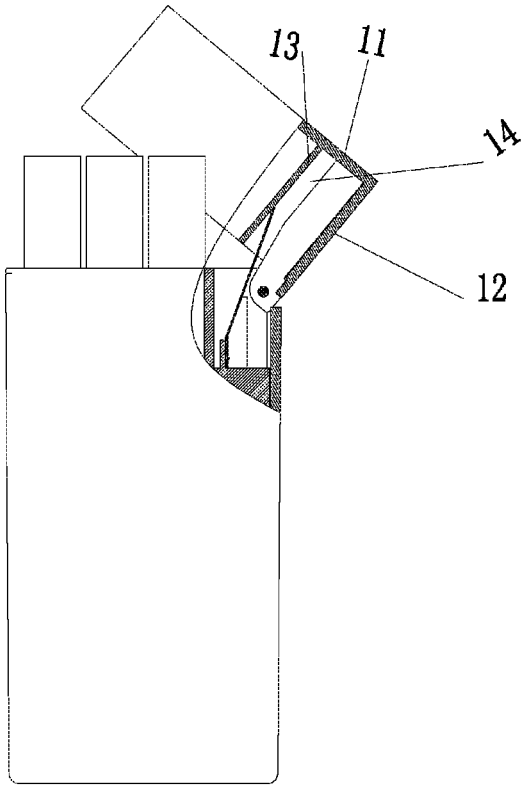
FIG. 4 illustrates a partially cutaway view of the electronic cigarette case according to the preferred embodiment provided in the present application.

As shown in FIG. 4, the case cover 1 includes an upper wall 11, a side wall 12 and a limit arm 13. The side wall 12 downwardly and vertically extends around the upper wall 11, thereby forming an accommodating cavity for accommodating parts of the electronic cigarettes 5. The limit arm 13 is located in the accommodating cavity, extends perpendicularly from the upper wall 11 towards an opening direction of the case cover 1. The limit arm 13 has the same extension length as the side wall 12, and a gap 14 is formed between the limit arm 13 and the side wall 12. It is best for a width of the gap 14 to be slightly larger than a width of the maximal section of the flexible structure 3. One end of the flexible structure 3 is fixedly mounted in the recess 41 of the accommodating element 4; the other end of the flexible structure 3 extends into the gap 14 formed between the limit arm 13 and the side wall 12, and is further elastically abutted against the case cover 1. In a further embodiment, it is possible that the case cover 1 has no limit arm 13, and the flexible structure 3 is directly and elastically abutted against the inner wall of the case cover 1.

Figure 2:
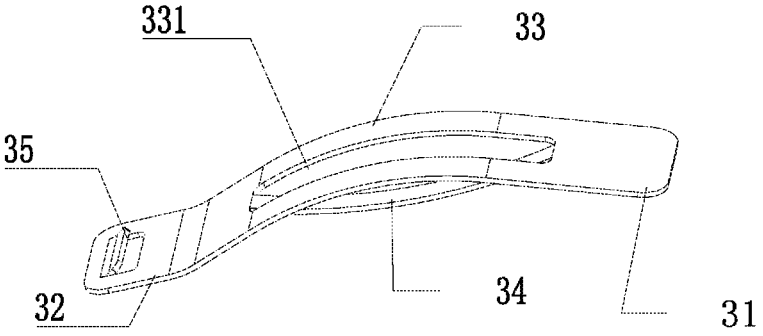
FIG. 2 illustrates a schematic view of the flexible structure shown in FIG. 1 according to the preferred embodiment provided in the present application.

As shown in FIG. 2, the flexible structure 3 includes a fixing portion 32, an abutting portion 31, a deformable portion 33, an elastic band 34, and a bending portion 35. In this case, two ends of the deformable portion 33 extend with respect to each other, thereby forming the fixing portion 32 and the abutting portion 31. The fixing portion 32 is partially fixed in the recess 41 of the accommodating element 4. The abutting portion 31 extends into the gap 14 formed between the limit arm 13 and the side wall 12, and is further elastically abutted against the case cover 1. The abutting portion 31 is further slidably connected to the case cover 1 in the gap 14. The deformable portion 33 and the elastic band 34 will undergo an elastic deformation during the movement of the case cover 1. In this way, the fixing portion 32 and the abutting portion 31 move in the same direction such that the case cover 1 is opened or closed. Two ends of the elastic band 34 are respectively mounted at connection joints between the deformable portion 33 and the fixing portion 32, and between the deformable portion 33 and the abutting portion 31. A deformation space is formed between the elastic band 34 and the deformable portion 33. A cross-section of the deformation space is preferably in shape of an olive, in order to facilitate the occurring of the deformation. The bending portion 35 is arranged on the fixing portion 32, and is configured to fix the fixing portion 32 into the recess 41 of the accommodating element 4. Certainly, in a further embodiment, it is possible for the flexible structure 3 to include only the fixing portion 32 and the deformable portion 33.

In this embodiment, preferably, the fixing portion 32 and the abutting portion 31 respectively extending from two ends of the deformable portion 33 have the same length, while curvature of the fixing portion 32 is the same as that of the abutting portion 31. In this way, during the deformation of the deformable portion 33, the movements of the fixing portion 32 and of the abutting portion 31 keep in consistent with each other.

In this embodiment, a strip-shaped hole 331 is preferably defined in the deformable portion 33; wherein the strip-shaped hole 331 has the same length as the elastic band 34, and a location of the strip-shaped hole 331 corresponds to that of the elastic band 34. A width of the strip-shaped hole 331 is preferably slightly larger than a width of the cross-section of the elastic band 34. It can achieve a better deformation with the design of the strip-shaped hole 331; in this way, when the case cover 1 is opened or closed to a certain angle, the case cover 1 is capable of being completely opened or closed automatically.

In this embodiment, cross sections of the fixing portion 32, the abutting portion 31 and the deformable portion 33 are in shape of curves. This type of design facilitates the deformable portion 33 to deform, and further causes the fixing portion 32 and the abutting portion 31 to move in the same direction.

In this embodiment, the bending portion 35 may be designed in form of a buckle. A buckle hole matching with the buckle is defined in a corresponding position in the recess 41 of the accommodating element 4. During the assembly process, the fixation of the flexible structure 3 is achieved only by buckling the buckle into the buckle hole. When using this type of design, no more assembly components or complex processes are needed during the fixation of the flexible structure 3, and the manufacturing cost is reduced.

In this embodiment, the flexible structure 3 is made of metal material, and preferably made of metal material having a good elasticity, such as stainless steel.

In this embodiment, the flexible structure 3 is an integrated type structure. In this way, it is convenient for the mounting of the flexible structure 3, and helps to reduce the manufacturing processes of the electronic cigarette case. Besides, it is possible to ensure the stability of the whole cigarette case with the integrated type structure.

Using the electronic cigarette case provided in the present application, when opening the case cover 1, the flexible structure 3 undergoes a first elastic deformation along the moving direction of the case cover 1 relative to the case body 2. When closing the case cover 1, the flexible structure 3 undergoes a second elastic deformation in a direction opposite to the moving direction while the first elastic deformation occurs.

During the opening of the case cover 1, when the angle between the case cover 1 and the case body 2 is larger than 40°, the flexible structure 3 undergoes the first elastic deformation. During the closing of the case cover 1, when the angle between the case cover 1 and the case body 2 is less than 40°, the flexible structure 3 undergoes the second elastic deformation.

The working principle of the electronic cigarette case provided in the present application is explained with reference to FIGS. 4, 5*a*-5*c* which show a moving process for opening the electronic cigarette case.

Figure 5A:
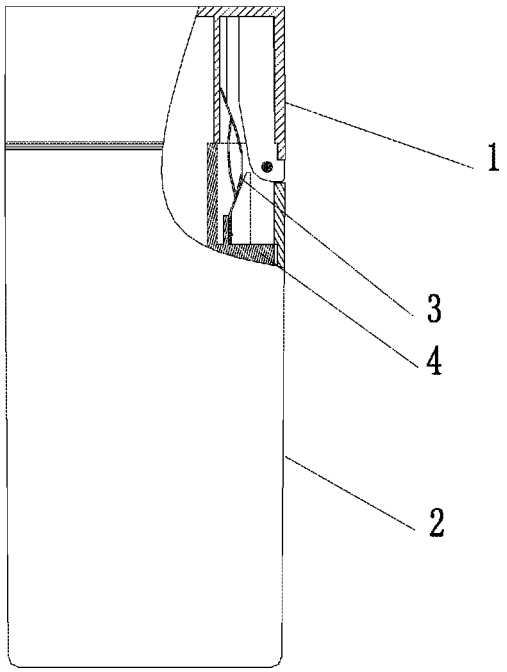
FIG. 5*a* is a view illustrating the electronic cigarette case in an initial state before the case cover is opened.
Figure 5B:
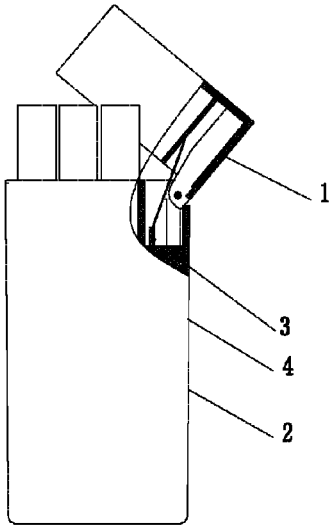
FIG. 5*b* is a view illustrating the electronic cigarette case which is not completely opened during the opening process of the case cover.
Figure 5C:
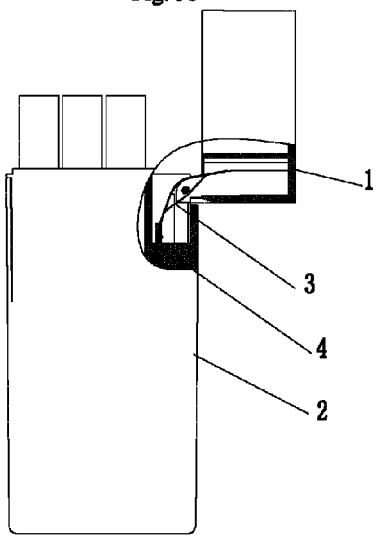
FIG. 5*c* is a view illustrating the electronic cigarette case which is completely opened during the opening process of the case cover.

As shown in FIGS. 4 and 5*a*, an initial state of the electronic cigarette case is closed; wherein one end of the flexible structure 3 is fixed in the recess 41 of the accommodating element 4, and the other end thereof extends into the gap 14 of the case cover 1, and is further elastically abutted against the limit arm 13. As shown in FIG. 5*b*, the electronic cigarette case is in a half-open state; that is, not completely opened. At this time, the angle between the case cover 1 and the case body 2 is approximately 40°, the deformable portion 33 and the elastic band 34 of the flexible structure 3 undergo an elastic deformation, and thus the deformable portion 33 and the elastic band 34 fit together. Furthermore, since the deformable portion 33 undergoes an elastic deformation, the abutting portion 31 is caused to slide in the gap 14. When the angle between the case cover 1 and the case body 2 further increases, that is, larger than 40°, the deformable portion 33 undergoes an elastic deformation (i.e., the first elastic deformation) along the moving direction of the case cover 1 relative to the case body 2, meanwhile the elastic band 34 undergoes a corresponding elastic deformation, thereby causing the abutting portion 31 to slide until it is elastically abutted against the side wall 12. During the deformation process of the flexible structure 3, a deformation force is generated, which is applied to the side wall 12 of the case cover 1 by means of the abutting portion 31, and thus the case cover 1 is completely pushed open (referring to the state shown in FIG. 5*c*).

The working principle of the electronic cigarette case provided in the present application is further explained with reference to FIGS. 6*a*-6*c* which show a moving process for closing the electronic cigarette case.

Figure 6A:
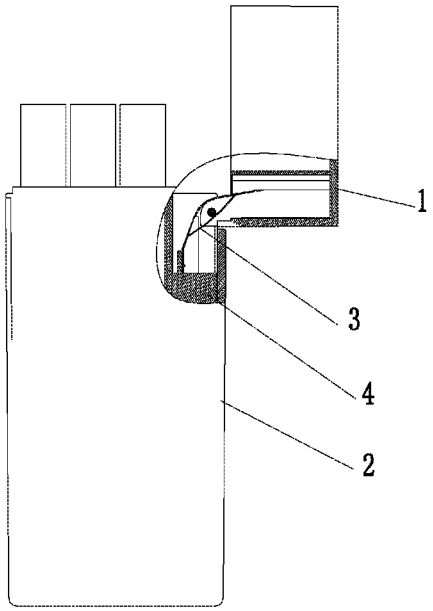
FIG. 6*a* is a view illustrating the electronic cigarette case in an initial state before the case cover is closed.
Figure 6B:
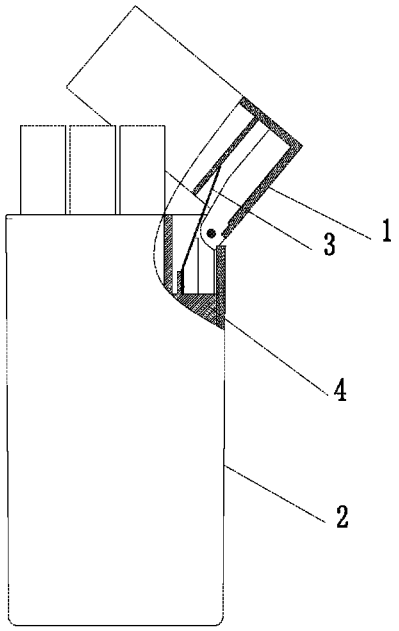
FIG. 6*b* is a view illustrating the electronic cigarette case which is not completely closed during the closing process of the case cover.
Figure 6C:
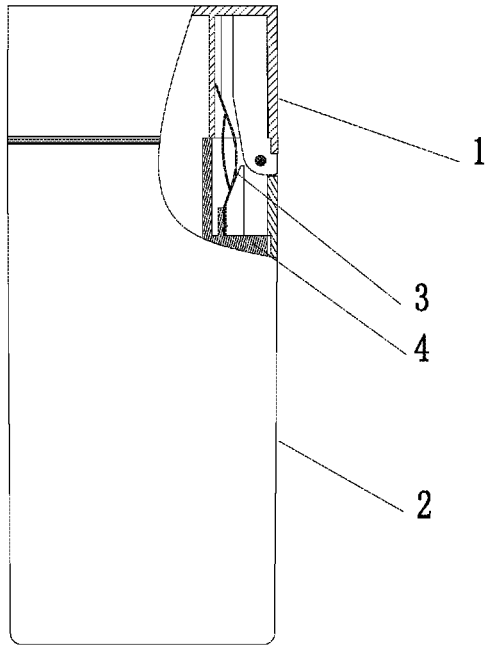
FIG. 6*c* is a view illustrating the electronic cigarette case which is completely closed during the closing process of the case cover.

As shown in FIGS. 4 and 6*a*, an initial state of the electronic cigarette case is opened; at this time, the flexible structure 3 is in a state undergoing the first elastic deformation; one end of the flexible structure 3 is fixed in the recess 41 of the accommodating element 4, and the other end thereof extends into the gap 14 of the case cover 1, and is further elastically abutted against the side wall 12. As shown in FIG. 6*b*, the electronic cigarette case is in a half-close state; that is, not completely closed. At this time, the angle between the case cover 1 and the case body 2 is approximately 40°, the deformable portion 33 and the elastic band 34 of the flexible structure 3 respectively undergo an elastic deformation (in a direction opposite to the direction in the opening process), and thus the deformable portion 33 and the elastic band 34 fit together. Furthermore, since the deformable portion 33 undergoes an elastic deformation, the abutting portion 31 is caused to slide in the gap 14. With the further decreasing of the angle between the case cover 1 and the case body 2, when the angle is less than 40°, the deformable portion 33 undergoes an elastic deformation (i.e., the second elastic deformation) in a direction opposite to the moving direction in which the first elastic deformation occurs, meanwhile the elastic band 34 undergoes a corresponding elastic deformation, thereby causing the abutting portion 31 to slide until it is elastically abutted against the limit arm 13. During the deformation process of the flexible structure 3, a deformation force is generated, which is applied to the limit arm 13 of the case cover 1 by means of the abutting portion 31, and thus the case cover 1 is completely closed (referring to the state shown in FIG. 6*c*).

It should be understood that, those skilled in the art may make many improvements or modifications based on the description described above. All these belong to the protection of the present application.

The invention claimed is:

1. An electronic cigarette case, comprising a case body (2) and a case cover (1) rotatably connected to the case body (2); wherein the electronic cigarette case further comprises a flexible structure (3); one end of the flexible structure (3) is connected to the case body (2), and the other end of the flexible structure (3) is connected to the case cover (1);

when opening the case cover (1), the flexible structure (3) undergoes a first elastic deformation along a moving direction of the case cover (1) relative to the case body (2);

when closing the case cover (1), the flexible structure (3) undergoes a second elastic deformation in a direction opposite to the moving direction in which the first elastic deformation occurs;

wherein the flexible structure (3) includes a deformable portion (33), and a fixing portion (32) and an abutting portion (31) formed by respectively extending from two ends of the deformable portion (33); the fixing portion (32) is connected to the case body, and the abutting portion (31) is connected to case cover (1); the deformable portion (33) undergoes the first elastic deformation or the second elastic deformation during the movement of the case cover (1), causing the fixing portion (32) and the abutting portion (31) to move in a same direction in such a way that the case cover (1) is closed or opened; and wherein the flexible structure (3) further includes an elastic band (34); two ends of the elastic band (34) are respectively connected to the two ends of the deformable portion (33); a deformation space is formed between the deformable portion (33) and the elastic band (34).

2. The electronic cigarette case according to claim 1, wherein during the opening of the case cover (1), when an angle between the case cover (1) and the case body (2) is larger than 40°, the flexible structure (3) undergoes the first elastic deformation; during the closing of the case cover (1), when the angle between the case cover (1) and the case body (2) is less than 40°, the flexible structure (3) undergoes the second elastic deformation.

3. The electronic cigarette case according to claim 1, wherein cross sections of the fixing portion (32), the abutting portion (31) and the deformable portion (33) are in shape of curves.

4. The electronic cigarette case according to claim 3, wherein the fixing portion (32) and the abutting portion (31) respectively extending from two ends of the deformable portion (33) have the same length; while curvature of the fixing portion (32) is the same as that of the abutting portion (31).

5. The electronic cigarette case according to claim 1, wherein a cross-section of the deformation space formed between the deformable portion (33) and the elastic band (34) is in shape of an olive.

6. The electronic cigarette case according to claim 1, wherein a strip-shaped hole (331) is defined in the deformable portion (33); the strip-shaped hole (331) has the same length as the elastic band (34), and a location of the strip-shaped hole (331) corresponds to that of the elastic band (34).

7. The electronic cigarette case according to claim 1, wherein one end of the flexible structure (3) is fixedly connected to the case body (2), while the other end of the flexible structure (3) is elastically abutted against the case cover (1), and is further slidably connected to the case cover (1).

8. The electronic cigarette case according to claim 7, wherein the electronic cigarette case further comprises an accommodating element (4) for disposing electronic cigarettes; the accommodating element (4) is disposed in the case body (2), and is further detachably connected to the case body (2); a recess (41) is defined on a side wall of the accommodating element (4), the side wall is oriented to a movable connection joint between the case body (2) and the case cover (1); one end of the flexible structure (3) is fixedly mounted in the recess (41).

9. The electronic cigarette case according to claim 7, wherein the case cover (1) includes an upper wall (11), a side wall (12), and a limit arm (13); the side wall (12) downwardly and vertically extends around the upper wall (11), thereby forming an accommodating cavity; the limit arm (13) is located in the accommodating cavity, and extends perpendicularly from the upper wall (11) towards an opening direction of the case cover (1); the limit arm (13) has the same extension length as the side wall (12), and a gap (14) is formed between the limit arm (13) and the side wall (12).

10. The electronic cigarette case according to claim 9, wherein one end of the flexible structure (3) is fixedly mounted in the recess (41) of the accommodating element (4); the other end of the flexible structure (3) extends into the gap (14) formed between the limit arm (13) and the side wall (12), and is further elastically abutted against the case cover (1).

11. The electronic cigarette case according to claim 7, wherein the flexible structure (3) further includes a bending portion (35); the bending portion (35) is arranged on the fixing portion (32), and is configured to fix the fixing portion (32) into the accommodating element (4).

12. The electronic cigarette case according to claim 11, wherein the bending portion (35) is a buckle, and a buckle hole is defined in a position in the recess (41) of the accommodating element (4) that corresponds to the buckle of the fixing portion (32); the buckle is buckled into the buckle hole such that the fixing portion (32) is fixed in the accommodating element (4).

13. The electronic cigarette case according to claim 1, wherein the flexible structure (3) is made of metal material.

14. The electronic cigarette case according to claim 13, wherein the flexible structure (3) is an integrated type structure.

* * * * *